US005458337A

United States Patent [19]

Jabben

[11] Patent Number: 5,458,337

[45] Date of Patent: Oct. 17, 1995

[54] CONTROLLED PENETRATION TIP FOR ARROWS

[76] Inventor: Keith W. Jabben, Rte. 4, Box 214-C, Independence, Kans. 67301

[21] Appl. No.: 149,989

[22] Filed: Nov. 10, 1993

[51] Int. Cl.[6] ..... F42B 6/08

[52] U.S. Cl. ..... 273/419; D22/115

[58] Field of Search ..... 273/416, 419, 273/420–422; D22/115

[56] References Cited

U.S. PATENT DOCUMENTS

| | | | |
|---|---|---|---|
| D. 244,448 | 5/1977 | Bonine et al. | D22/115 |
| 2,905,470 | 9/1959 | Hoyt | 273/106.5 |
| 2,940,758 | 6/1960 | Richter | 273/119 X |
| 4,254,958 | 3/1981 | Bateman | 273/421 |
| 5,114,156 | 5/1992 | Saunders | 273/419 |
| 5,269,534 | 12/1993 | Saunders et al. | 273/419 |

OTHER PUBLICATIONS

Archer's Bible 1966–67 Mar. 1967 p. 74 Slipover Nonskid Field Point Archer, Dec. 1978 p. 7.

Bear Archery 1977, May 1977 p. 33, Arrow Points Depicted in Lower Right Corner.

*Primary Examiner*—Paul E. Shapiro

[57] ABSTRACT

An controlled penetration arrow tip which has a penetration enhancing section at the point which is followed by an energy imparting or energy transferring section. This energy imparting section may resist complete penetration of an animal or penetration into unintended material, such as trees. The body and/or trailing end may be tapered to improve penetration or aerodynamic characteristics. Facets or scallops may be used on the impacting end, body, and/or trailing end in order to improve aerodynamic characteristics. The trailing end may be truncated, flared, flanged, or otherwise made larger than the arrow shaft to increase the damage of tissue and/or the energy transferring characteristics and/or to render removal from animal difficult. This truncated section may be split, cut, notched, or otherwise separated to improve aerodynamic and/or tissue damaging characteristics. Ribs, turbines, fins, blades, or other outwardly extending surfaces may be used to improve tissue damaging and/or aerodynamic characteristics.

30 Claims, 5 Drawing Sheets

CONTROLLED PENETRATION TIP FOR ARROWS

FIELD OF INVENTION

This invention relates to archery, specifically to an improved arrow head or tip primarily used for but not restricted to shooting small game (rabbits, squirrels, etc.).

BACKGROUND OF INVENTION

For the previous century, small game or animals have been hunted largely with the use of arrow tips which were designed for target practice. These streamlined tips offer little resistance from complete penetration of the target animal, often allowing the arrow to pass through and exit the animal. This indicates a significant amount of energy of the traveling arrow is not being transferred to the animal, thereby reducing the effectiveness of the arrow and allowing the animal to only be wounded. Failure of the arrow to remain in the animal greatly increases the likelihood the wounded animal will travel a greater distance, thereby rendering recovery difficult or impossible. When an arrow, which is usually several times the length or width of the animal, is retained in the animal it impedes the animal's escape as it becomes entangled in vegetation. Also, these sharp ended arrow tips easily become lodged in trees when the intended target is missed, rendering recover difficult or impossible.

Blunted (flat faced) arrow tips are often used to restrict penetration and to transfer additional energy to the target animal. However, long distance shots or shots taken in heavy vegetation are often unable to sufficiently penetrate the animal, as excessive energy is expended before reaching the animal. Bows of average power or less, such as fifty-five pounds or less, are also unable to consistently penetrate animals using this type of tip. The combination of variations in the power of bows, physical weight of arrows, shooting distances, vegetation conditions, and the target toughness all affect the depth of animal penetration.

U.S. Pat. No. 2,905,470 to Earl H. Hoyt, Sep. 22, 1959, teaches an arrow tip comprising a flat washer with a perpendicular center spike design located on the impacting end. The impacting end is a larger diameter than the shaft. In a second embodiment, a thin, triangular, vertical, planer blade replaces the spike. Flat leading surfaces, such as this washer do not allow smooth air flow past or over the tip, thus impeding the arrow flight. The flat area of the tip also fails to effectively deflect grass or foliage, therefore adding to the flight inaccuracy.

U.S. Pat. No. 4,254,958 to Earle W. Bateman, Mar. 10, 1981, teaches a multi-directional, thin, vertical sided washer for use as an attachment for an arrow tip. This washer is attached to an arrow shaft by passing the threaded portion of an arrow tip through a hole in the center of the washer and screwing the arrow tip into a threaded adaptor, which has been inserted into the arrow shaft. This attachment adds weight to the tip area of an arrow, causing the arrow shaft to flex more and fly differently than with the standard arrow tip alone. This additional weight also changes the balance point of the arrow, thereby causing the arrow to fly differently than standard practice tips.

OBJECTS AND ADVANTAGES SUMMARY

Accordingly, several objects and advantages of my invention are as follows:

a) to provide an arrow tip which will penetrate small game under a wide range of hunting situations;

b) to provide an arrow tip with a means for reducing the possibility the arrow travels completely through and out of the target;

c) to provide an arrow tip with a means for preventing easy removal of the arrow from the animal by the continuous movement the animal after the hit, thereby causing said arrow to remain in said animal;

d) to provide an arrow tip shape which is not deflected by light obstacles, such as grass and foliage;

e) to provide an arrow tip with a means to contact animal tissue which may have been missed by conventional tips;

f) to provide an arrow tip which will reduce the penetration to an undesirable depth into unintended materials, such as trees or other objects which impede the recovery of a arrow;

g) to provide an arrow tip with a sharp edge(s), corner(s), or increased surface area which tend to cause more damage and faster death to an animal, thereby making the hit more humane;

h) to provide an arrow tip which is designed to be balanced as normal practice tips, thereby allowing normal arrow flight and accuracy; and i) to provide an arrow tip which may be economically produced.

I have discovered that by use of certain heretofore unknown variations in the impacting end and trailing end of arrow tips that the before mentioned objects and advantages will be achieved. Further objects and advantages of my invention will become apparent from a consideration of the drawings and ensuing description.

DRAWING FIGURES

REFERENCE NUMERALS IN DRAWINGS

20 impacting end

22 body

24 trailing end

26 central longitudinal axis

28 point of impacting end

30 small slope penetration enhancing section

32 large slope energy imparting section

Figure 1A:
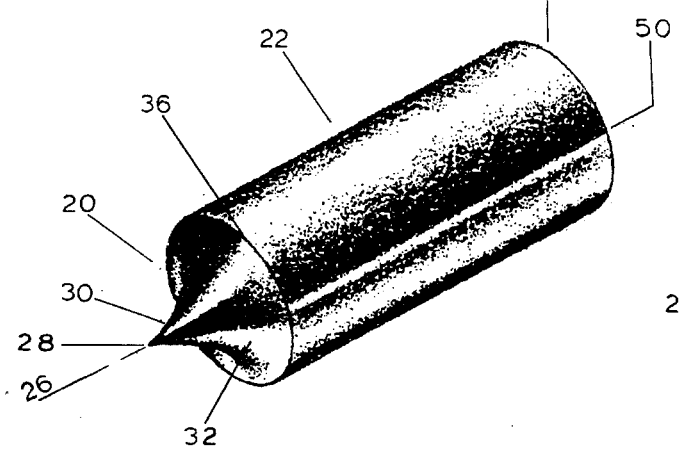
FIG. 1A is a perspective view of an arrow tip of the invention.

34 intersection, interface, or junction of the small and large slope sections

36 interface, intersection, or junction of the impacting end and body

38 facet

40 intersection of facets

42 outwardly extending members or surfaces

43 longitudinal axis of outwardly extending members

44 fins on outwardly extending surfaces

46 voids in outwardly extending surfaces

48 cutting surfaces of outwardly extending surfaces

50 rearward facing section of trailing end

DESCRIPTION OF INVENTION

This invention is a tip consisting essentially of a tubular body 22 having an impacting end 20 at one end of the body 22, a trailing end 24 at the opposing end of said body 22, an interface 36 between said body 22 and said impacting end 20, and a longitudinal axis 26; said impacting end 20 having a centrally located point 28, said point 28 being the apex of a first conical shaped small (in reference to said longitudinal axis 26) slope penetrating section 30 having a surface, wherein any tangent of said surface making an angle with said longitudinal axis 26 up to but not including fifty degrees. This surface traverses across an intersection 34 to a second conical shaped large (in reference to said longitudinal axis 26) slope energy imparting section 32 having a surface, wherein any tangent of said surface making an angle with said longitudinal axis 26 is from fifty degrees up to but not including ninety degrees. The traverse of the impacting end 20 concludes at the interface 36 with said body 22; said body 22 traversing into a truncated trailing end 24 having outwardly extending surfaces 42; the surfaces 42 being continuous or discontinuous around the perimeter of the trailing end 24.

With reference to the figures, the invention is more particularly described as a controlled penetration, energy imparting tip for an arrow which consists essentially a an impacting or leading end 20, a body 22, and a trailing end 24 attachable to a shaft of an arrow via an internal annulus or hole not shown, further the annulus having dimensions which permit it to encase the end of the shaft, and extending from the trailing end 24 towards, but not through, the impacting end 20. The impacting end 20 comprises a centrally located point 28 forming into a conical initial small slope section 30 (in reference to the longitudinal axis 26) as the body 22 is approached, further traversing into a second truncated conical shaped large slope section 32 (in reference to the longitudinal axis 26) ending in an interface, intersection, or junction 36 with the outer surface of the body 22. The body 22, extending from the impacting end 20, comprises a tubular shaped finite length optionally having various exterior surface contours. The trailing end 20 comprises a truncated construction transition of the tubular body 22 to the annulus, not shown.

Figure 13:
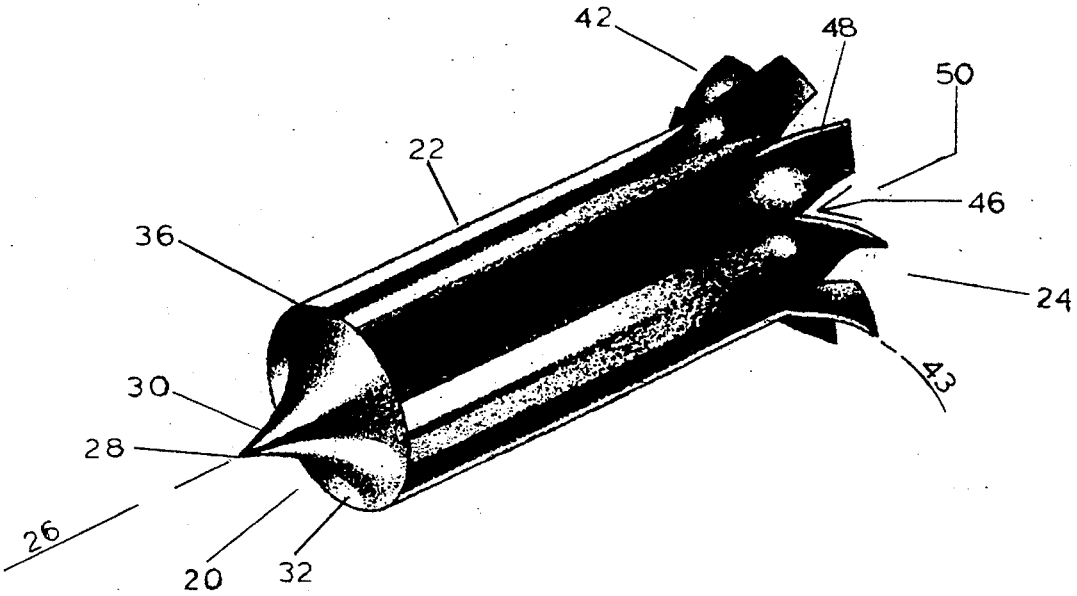
FIG. 13 is a perspective view of an invention arrow tip having a seventh configuration of the trailing end.

In another embodiment, the preferred embodiment shown in FIG. 13, an energy transferring, further reduced exiting tip comprises a leading end 20, a body 22, and at least one extending member or surface 42 from said body 22; said tip also attachable to a shaft via an internal annulus as described above. The extending member 42 comprises various configurations of an extending element 44 above the outer surface of the body 22 or trailing end 24, as shown in FIG. 13 of the preferred embodiment. Alternately, the extending member 42 can be a separate section attached to the outer surface of the tubular body 22. The arrow tip has a central longitudinal axis 26 extending from the center of the impacting end 20 through the body 22 to the trailing end 24.

Figure 2A:
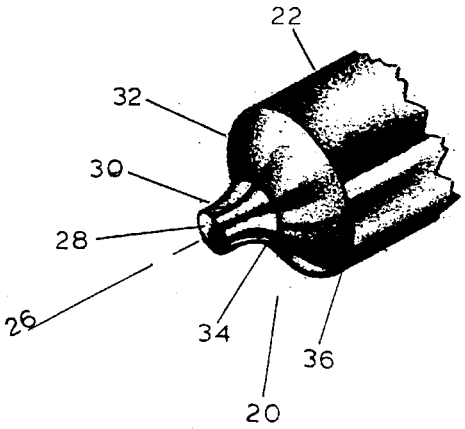
FIG. 2A is a fragmented perspective view of the impacting end of an invention arrow tip having a second configuration.
Figure 2B:
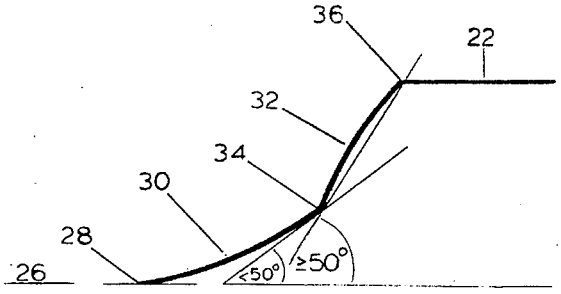
FIG. 2B is a graphical representation of a fragmented side view of the impacting end of the arrow tip in FIG. 2A, taken from the central longitudinal axis to the outer body surface showing the surface lines of the impacting end.
Figure 5A:
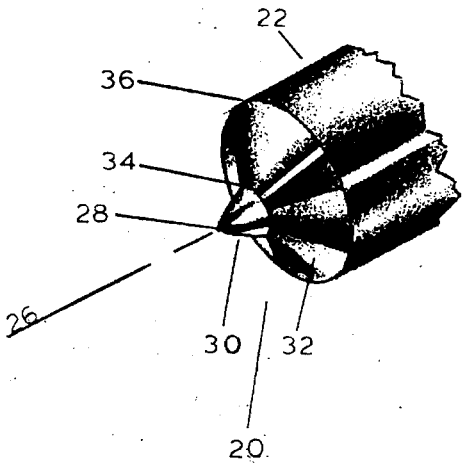
FIG. 5A is a fragmented perspective view of the impacting end of an invention arrow tip having a fifth configuration.
Figure 6A:
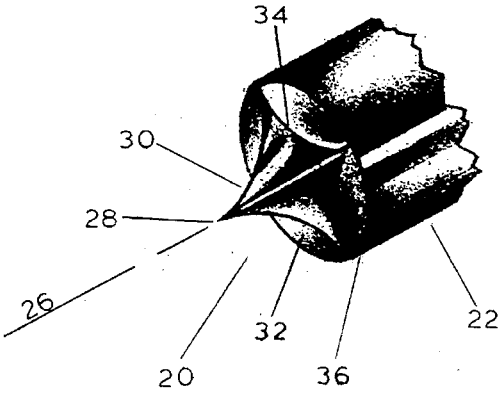
FIG. 6A is a fragmented perspective view of the impacting end of an invention arrow tip having a sixth configuration.
Figure 6B:
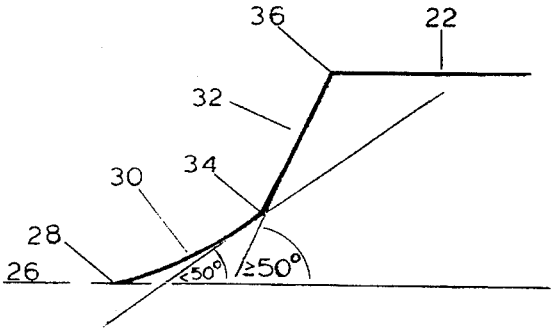
FIG. 6B is a graphical representation of a fragmented side view of the impacting end of the arrow tip in FIG. 6A, taken from the central longitudinal axis to the outer body surface showing the surface lines of the impacting end.
Figure 7:
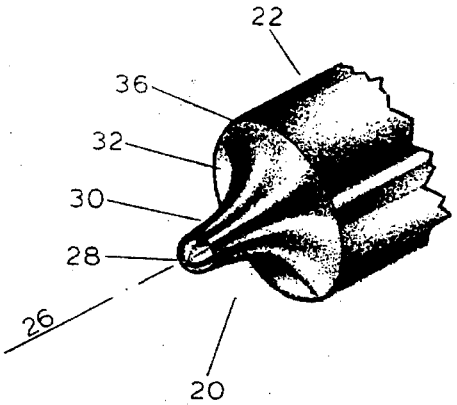
FIG. 7 is a fragmented perspective view of the impacting end of an invention arrow tip having a seventh configuration.

As shown in FIG. 1A and in FIG. 13, the preferred embodiment, the impacting end 20 comprises a central, sharp point 28 located on a central longitudinal axis 26, a first small sloping or penetration enhancing section 30, a second large sloping or energy imparting/transferring section 32, and an intersection, interface or junction 36 between the large sloping section 32 and the body 22, this interface 36 is defined as the area or location where the impacting end 20 meets or joins the body 22. The central point 28 comprises the apex of the first conical small slope section 30, which then traverses across the second conical large sloping section 32, ending at the interface 36. The traverse 34 of the small slope section 30 to the large slope section 32 as well as the interface 36 of the large slope section 32 and the body 22 may be continuous or discontinuous. Continuous is defined as a smooth transition without distinct surface interruptions, such as lines, with the traverse of the two slope sections best shown in FIGS. 1A and 13. Discontinuous is defined as being without a smooth transition or with observable surface interruption(s), such as lines or ridges, as best shown in FIGS. 2A, 3A, 4A, 5A, and 6A. The penetration enhancing feature of the invention comprises a central point 28 and a small slope section 30. The point 28 has a sharp or peaked construction, as shown in FIGS. 1A, 6A, 8, and 13. It is also envisioned the point 28 may be of various shapes all the way from flat as shown in FIG. 2A to blunt rounded as shown in FIG. 7 to pointed rounded as shown in FIGS.

Figure 8:
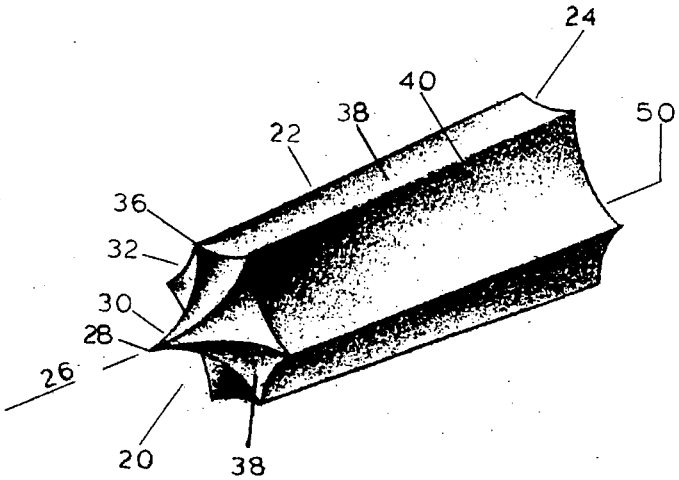
FIG. 8 is a perspective view of an invention arrow tip having a eighth configuration.

3A, 4A, and 5A to sharp pointed as in the preferred embodiment, as shown in FIGS. 1A, 8, and 13. In the case of the flat surfaced point construction, as shown in FIG. 2A, the diameter of the point 28 may be from just above zero, giving a sharp point configuration as shown in FIGS. 1A, 8, 13, up to one half of the diameter of the body 22, giving a flat point configuration as shown FIG. 2A. The actual construction is defined by the strength of the material used and the intended use of the tip.

Figure 1B:
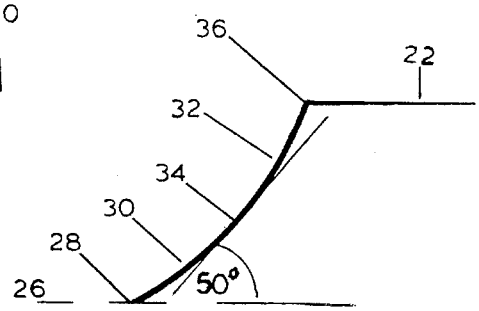
FIG. 1B is a graphical representation of a fragmented side view of the impacting end of the arrow tip in FIG. 1A, taken from the central longitudinal axis to the outer body surface showing the surface lines of the impacting end.
Figure 3A:
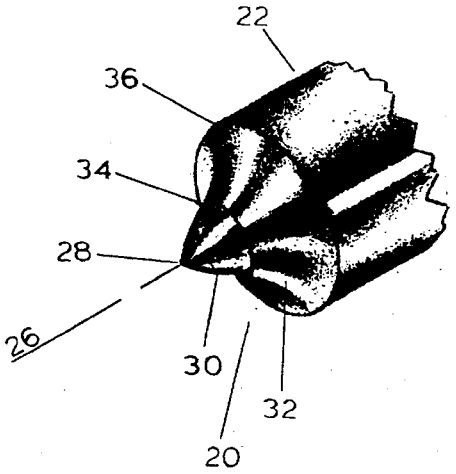
FIG. 3A is a fragmented perspective view of the impacting end of an invention arrow tip having a third configuration.
Figure 3B:
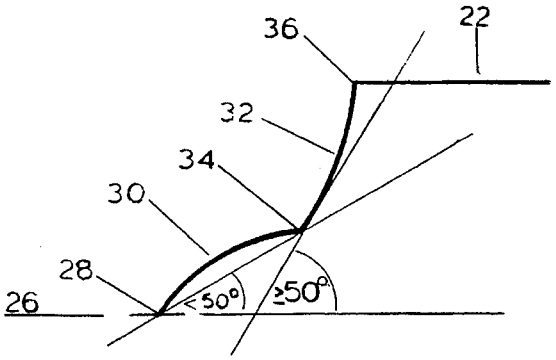
FIG. 3B is a graphical representation of a fragmented side view of the impacting end of the arrow tip in FIG. 3A, taken from the central longitudinal axis to the outer body surface showing the surface lines of the impacting end.
Figure 4A:
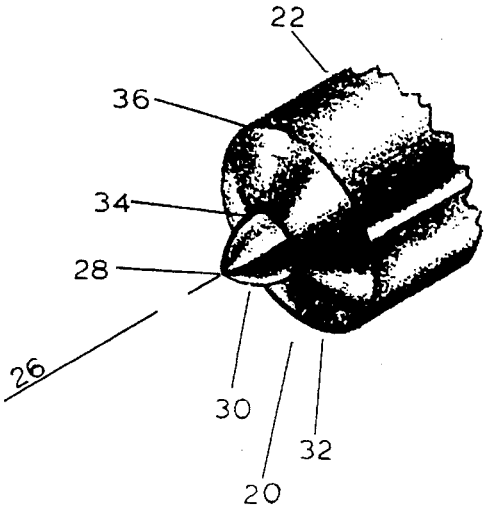
FIG. 4A is a fragmented perspective view of the impacting end of an invention arrow tip having a fourth configuration.
Figure 4B:
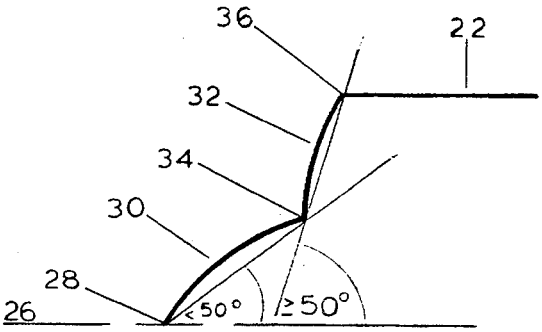
FIG. 4B is a graphical representation of a fragmented side view of the impacting end of the arrow tip in FIG. 4A, taken from the central longitudinal axis to the outer body surface showing the surface lines of the impacting end.
Figure 5B:
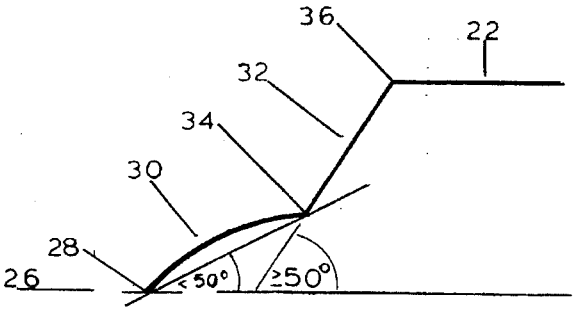
FIG. 5B is a graphical representation of a fragmented side view of the impacting end of the arrow tip in FIG. 5A, taken from the central longitudinal axis to the outer body surface showing the surface lines of the impacting end.

The small sloping section 30 has a concave shaped conical surface as viewed around the longitudinal axis 26. The small sloping section 30 is further defined as the area of the impacting end 20 whose tangent to the surface and the central longitudinal axis 26 is up to but not including fifty degrees. This results in a slope surface which generally trends more parallel than perpendicular with the longitudinal axis 26, as illustrated in FIG. 1B. Alternatively, it is also envisioned the small slope section 30 may have a convex shaped conical surface, as shown in FIGS. 3A, 4A, and 5A. In the case of a convex surface, the slope of the surface is established by a plane extending between the point 28 and the intersection 34 of the small sloping section 30 and the large sloping section 32. This slope will be up to but not including fifty degrees in relationship to the central longitudinal axis 26, as illustrated in FIGS. 3B, 4B, and 5B. This also results in a sloped surface which generally trends more parallel than perpendicular with the longitudinal axis 26, said axis 26 being referred as zero degrees. It is within the scope of this invention the concave and convex surface of the small sloping section 30 can approach but not be a linear slope surface. In other words, the first sloping surface 30 must be concave or convex. The scope of the invention does not limit the concave or convex shape to a uniform symmetry distribution over the length of the section. Symmetrical distribution is defined as the condition where the length of the slope section 30 or 32 having tangent lines between the smallest angle of the slope section and one half of the largest angle is equal to the length of the slope section having tangent lines between one half the largest angle and the largest angle of the slope section, again referencing angles to the central longitudinal axis 26. Asymmetrical or non-uniform symmetry distribution, also envisioned in the tip construction, is defined as the condition where the lengths of these two slope sections are not equal, as shown in FIG. 7.

The large sloping section 32 has a concave shaped conical surface as viewed around the longitudinal axis 26. The large sloping section 32 is further defined as the area of the impacting end 20 whose any tangent to the surface and the central longitudinal axis 26 is from fifty degrees up to but not including ninety degrees. This results in a sloped surface which generally trends more perpendicular than parallel to the longitudinal axis 26, as illustrated in FIGS. 1B and 3B. Alternatively, it is also envisioned the large sloping surface 32 may be convex, as shown in FIGS. 2A and 4A, or flat or straight as shown in FIGS. 5A and 6A. In the case of a convex surface as shown in FIGS. 2A and 4A, the slope of the surface 32 again is established by a plane, said plane extending from between the intersection 34 of the small sloping section 30 and the large sloping section 32 to the interface 36 between the large sloping surface 32 and the body 22. This slope, or the straight plane of FIGS. 5A and 6A as illustrated in, FIGS. 5B and 6B, will be from fifty degrees up to but not including ninety degrees in relationship to the central longitudinal axis 26. This results in a sloped surface which generally trends more perpendicular than parallel to the longitudinal axis 26, as illustrated in FIGS. 3B, 4B, 5B, and 6B. The intersection 34 between the small slope section 30 and the large slope section 32 is defined as the area of the largest diameter which is smaller than the smallest diameter included in the large slope section definition. The scope of the invention does not limit the concave or convex shape of this section to a uniform symmetry distribution over the length of the section as defined above. In other words, it may be asymmetrical or of a non-uniform symmetry distribution.

The preferred embodiment of the impacting end 20, similar to that shown in FIGS. 1A and 13, shows a smooth, continuous, aerodynamically enhanced surface formed by a point 28, a small slope concave shaped section 30, a large slope concave shaped section 32, and a interface 36. It is also envisioned at least one sloped surface of the impacting end 20 may be of a discontinuous shape as rotated around the longitudinal axis 26. For example, a discontinuous shape known as faceted, as shown in FIGS. 6A and 8, comprises a plurality of distinct small surface sections 38 spaced on the sloped surface 30 or 32 such as to make up a complete surface. Faceting is defined as surface planes, whether contoured or straight in the lateral direction, being arranged to form a complete surface. Lateral being defined as traversing radially around the central longitudinal axis 26. This faceted characteristic can be applied to either or both sloped sections 30 and 32 of the impacting end 20. When faceting is used, the conical surfaces have a discontinuous conical like effect. For example, three facets would form a three sided pyramid shape. Any number of facets may be used.

The impacting end 20 may have any combination of the surface shapes defined above and still be within the scope of the invention. For example, a convex small slope section 30 and a concave large slope section 32 as shown in FIG. 3A, or a convex small slope section 30 and a straight large slope section 32 as shown in FIG. 5A.

The body 22, as shown in FIG. 1A, comprises a smooth surfaced cylindrical tubular configuration extending from the impacting end 20 to the trailing end 24. The diameter and length of body 22 are suitable so that it can be attached to a shaft in a manner well known in the art. This attachment is often accomplished via the internal annulus, which may be shaped to the shaft, not necessarily the same shape as the exterior surface shape. The invention arrow tip may have an outward extending section from the annulus (the annulus no longer present in this situation) with threads for attaching to aluminum shafts, as is well known in the art. It is within the scope of the invention the body 22 and the trailing end 24 can also be faceted along the length and in the longitudinal as well as lateral directions, as shown in FIG. 8. The intersections 40 of these faceted areas 38 may provide a means for extending the outer surface of the arrow tip without increasing the weight of the tip in order to allow contact of additional animal tissue. This may be desirable in order to increase the amount of tissue which is damaged and/or to increase the drag or resistance to penetration. The net result is to transfer additional energy to the animal and prevent the arrow from exiting the animal.

A second embodiment of the arrow tip comprises a leading end 20 attached to and ahead of a body 22 which is followed by a trailing end 24, and having at least one extending member or surface 42, such as in FIG. 13.

The leading end 20 may be any style tip well known in the art such as U.S. Pat. No. 2,905,470, or may be one of the tips previously described.

The body 22 may be any shape also well known in the art such as also found in U.S. Pat. No. 2,905,470, or may be one of the shapes previously described.

Figure 9:
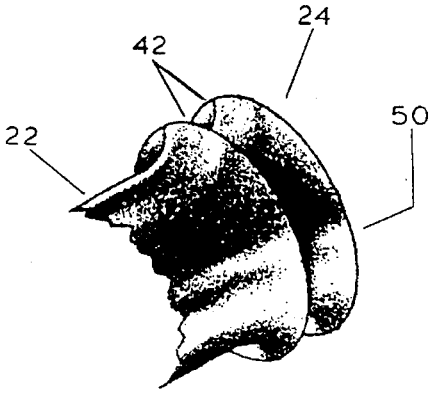
FIG. 9 is a fragmented perspective view of the trailing end of the invention arrow tip having a third configuration.
Figure 10:
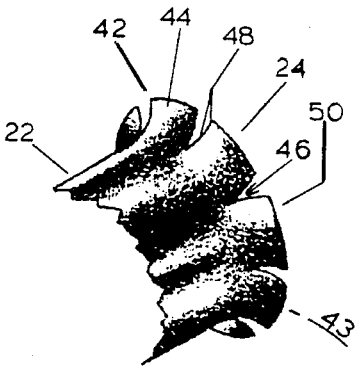
FIG. 10 is a fragmented perspective view of the trailing end of an invention arrow tip having a fourth configuration.
Figure 11:
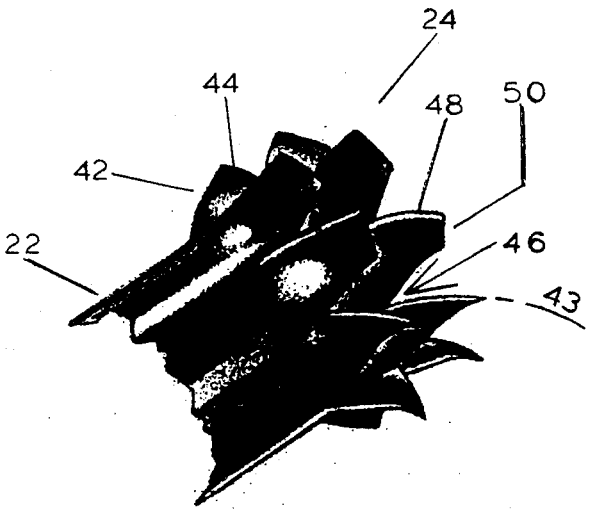
FIG. 11 is a fragmented perspective view of the trailing end of an invention arrow tip having a fifth configuration.
Figure 12:
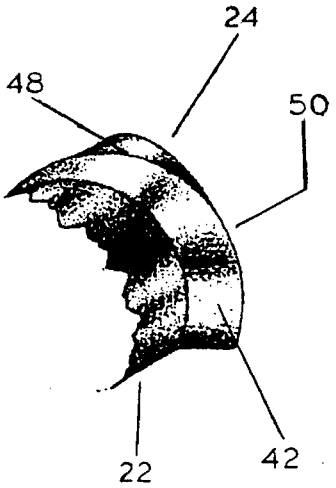
FIG. 12 is a fragmented perspective view of the trailing end of an invention arrow tip having a sixth configuration.

The extending member 42 may be any surface having a width of at least two percent of the largest circumference of the tip and extending outward from the body surface 22 and/or trailing end 24 to beyond the body surface 22. This extending member 42 preferably is a raised section of the body 22 and, more preferably, several raised sections of the trailing end 24 so as to essentially extend, discontinuously, around it's circumference or perimeter. Also within the scope of the invention, the extending members 42 may be additional material such as pyramid or other shaped structures of aluminum or other material attached to said body 22, and may be located along the length, radially around, or both, in reference to the central longitudinal axis 26. It is further envisioned a plurality of outward extending surfaces 42 be located over the surface of the body 22 and comprise various shapes. The angle of the longitudinal axis 43 of the extending member(s) 42 to the central longitudinal axis 26 can range from greater than zero up to about but not including 180 degrees, and can have single angle or multi-angle surfaces, or surfaces of various angles. The extending member(s) 42 may comprise one or more shapes such as ribs, journals, or rings as shown in FIG. 9, threads as shown in FIG. 12, grooves or fins as shown in FIG. 10, turbines as shown in FIG. 13, blades or intersections 40 of facets 38 as shown in FIG. 8, or other surfaces extending outwardly away from the central longitudinal axis 26. It is also envisioned these extending members 42 may be positioned along the body 22 and/or trailing end 24 and in a helical or spiraling manner, as shown in FIG. 12, or in other manners. These extending member surfaces 42 may be continuous, as shown in FIGS. 9 and 12, or discontinuous as shown in FIGS. 10, 11 and 13. Also, the members 42 may be arranged in an interdigitating manner, meaning one row of discontinuous members are offset radially from the next row, thus allowing the open spaces of one row to align with the members of another row, as best shown in FIG. 11.

Extending member(s) 42, when in a ring design, comprise a truncated, flared, or flanged construction extending away from body 22, as shown in FIG. 9. This truncated extending member 42 may, as stated earlier, have a continuous surface, as shown in FIG. 9, or may have a discontinuous surface caused by splits, cuts, notches, or voids 46 to form fins 44, as shown in FIG. 10, blades or turbines 44, as shown in FIGS. 11 and 13, or other means for increasing the size, width, or diameter of the arrow tip without impairing the aerodynamics of the tip. These fins 44 extend away from body 22, thereby causing aerodynamic voids, vents, or gaps 46 to occur in an outward extending surface 42 which allows cutting, slicing, slitting, or otherwise tissue damaging surfaces, edges, or corners 48 to be exposed. Outwardly extending members 42 may be arranged in a contoured, angled, twisted, offset, chambered, helical, or spiral fashion which further enhances the aerodynamic characteristics of the arrow tip by imparting a stabilizing spin while providing increased exposure of the cutting surfaces 48.

A plurality of outwardly extending surfaces 42 may be arranged along the body 22 and/or on the trailing end 24, as shown in FIG. 11. They also may be situated at only one location on the body or on the trailing end. Different shapes of extending members may be combined with each other to achieve different impacting results.

Within the scope of this invention any combination of impacting end 20, body 22, trailing end 24, and outwardly extending member(s) 42 can be utilized in conjunction with each other, with non-invention equivalents or features, or alone, while using metal, ceramic, carbon, plastic, or any other suitable material.

while the above description contains many specifications, these are not to be construed as limitations on the scope of the invention, but rather as an exemplification of some embodiments thereof. Many other variations are possible. For example, fins 44 or other extending members 42 could be attached to the impacting end 20, or the arrow tip could be attached to the arrow by any suitable means other than a central annulus, or the controlled penetration features may be utilized in situations other than in the field of archery or hunting animals. Accordingly, the scope of the invention should not be determined by the particular embodiments illustrated, but by the appended claims and their legal equivalents.

OPERATION OF INVENTION

As shown in FIGS. 1A and 13, the impacting end 20 comprises a central point 28 leading a gradually sloping or penetration enhancing section 30 traversing smoothly into a continuously elevating surface forming a penetration restricting or energy imparting section 32 immediately preceding the interface area 36 of the impacting end 20 and body 22, then traversing along the length of a body 22 toward and across a trailing end section 24 and terminating at a rearward facing surface 50. This arrow tip is attachable to an arrow by means of a central annulus beginning at the rearward facing surface 50 and extending along the longitudinal axis towards the impacting end 20.

As shown in FIGS. 1A and 13, the point 28 of the penetration enhancing section 28 is small enough to easily allow initial penetration into a tough skinned animal, even on marginal hits which might normally cause an arrow to deflect off of the animal and thereby only wound it. This ability to penetrate an animal will increase the effectiveness of all bows throughout their various ranges of power and hunting conditions. The small sloping section 30 allows the point 28 to penetrate the skin or tough tissue before the energy imparting/penetration resisting structure of the arrow tip restricts penetration. This allows any obstruction to begin movement around the arrow in order to permit additional penetration. This small slope section 30 is extended before the bulk of the arrow, allowing air and vegetation to begin flowing around the arrow, thereby enhancing the aerodynamic characteristics and reducing deflection or deceleration caused by vegetation. The large slope section 32 compresses animal tissue as well as deflects it around the arrow. Soft tissue is compressed while tough tissue and bones are compressed, broken, or deflected around the arrow. This serves to damage the encountered tissue while allowing the arrow tip to penetrate into additional tissue, but at a reduced rate. As the rate of penetration is reduced, additional tissue has more time to deflect around the arrow, thereby not absorbing the energy of the arrow as readily as during a high rate of penetration. Therefore, by using the invention, less powerful bows are able to get adequate penetration while more powerful bows retain the rate of penetration longer and therefore compress more tissue, which in turn, absorbs more energy and slows the arrow's rate of penetration. This results in bows of various power used under various conditions on various animals being able to penetrate adequately while transferring all or most of their energy to the animal.

The impacting end arrangements of the invention are also very effective in reducing penetration in unintended material, such as trees. The same principals apply, but the reaction of the target material (wood) is noticeably different from animal flesh. The small slope section 30 allows initial penetration and the large slope section 32 begins to rapidly transfer energy, just as with animal flesh. However, wood resists deflection and compression much more than animal tissue and even bones, as bones are able to shift about in the flesh. The large slope section 32 prevents the arrow tip from penetrating deeper into the wood, and in most cases the recoil from the sudden stop serves to expel the short (relative to standard target tips) penetration enhancing section 30 from the wood, allowing the arrow to fall to the ground and be recovered.

The trailing end 20, as shown in FIGS. 8, 9, 10, 11, 12, and 13, is larger than the intended arrow shaft and therefore forms a lip which serves to prevent easy removal of the arrow from the animal by the continuous movement of the animal after being hit, causing the arrow to remain in the animal and become entangled in vegetation, thereby assisting in the recovery of the animal.

The penetration enhancing section 30 of the embodiments shown in FIG. 2A, 3A, 4A, 5A and 7 are somewhat blunter than the embodiment shown in FIG. 1A. This allows these embodiments to retain their shape when used in extremely rocky terrain or when a soft material is used for their construction. The preferred embodiment can be easily modified to achieve this characteristic.

As shown in FIG. 8, the impacting end 20 and/or the body 22 and/or the trailing end 24 of this invention may be faceted or scalloped. The intersections 40 of facets 38 can be sharp to assist in cutting of tissue or bones. The intersections 40 of facets 38 located on or along the body 22 or trailing end 24 can be used to increase surface area without increasing the arrow tip weight or proportionately decreasing the aerodynamic characteristics, as air passage is allowed between the intersections 40 of the facets 38. As shown in FIG. 8, the body 22 and trailing end 24 may be tapered to increase the aerodynamic characteristics while increasing the surface area of the arrow tip. The larger size surface area serves to contact additional tissue and increase the size of the rearward facing section 50, thereby increasing the resistance of the arrow to being removed by the animal's movement.

A trailing end 24 can be truncated in order to increase the surface area, as shown in FIG. 9. Penetration sufficient to prove fatal, even while using very light powered bows, may be allowed when the outwardly extending surfaces 42 are positioned at the rear extremity of the trailing end 24, thereby allowing the impacting end 20 to contact vital tissue before the outward extending surfaces 42 retard penetration. These outward extending surfaces 42 will allow more energy to be transferred to an animal without an increase in arrow tip weight, as a thin wall between the center annulus and the outer surface can be formed or flared outward. Outward extending surface 42 also increases the resistance of the arrow from being removed by the animal's movement. Outward extending surfaces 42 can also be split, cut, notched, separated, or otherwise made to form fins, blades, turbines 44, as shown in FIG. 10. These fins 44 extend away from body 22 and end at rearward facing plane 50, thereby causing aerodynamic voids, vents, or gaps 46 to occur in the outward extending surface 42 which allows air passage past the arrow tip. This also exposes sharp corners, edges, or other cutting surfaces 48 which tend to lacerate or cut as the arrow tip passes through tissue. These cutting surfaces 48 also tend to grip tissue when the direction of travel is reversed, further increasing the resistance of the arrow from being removed by the animal's movement. As shown in FIG. 13, fins 44 may be arranged in a contoured, twisted, helical, or spiral fashion, which actually enhances the aerodynamic characteristics of the arrow tip by air pressure inducing rotation of the arrow .during flight. This rotation provides a stabilizing effect, just as feathers or vanes positioned on the arrow do. When fins 44 are positioned in this spiral manner, the aerodynamic characteristics of the arrow tip surpass those of a finless arrow tip, allowing a larger size arrow tip to be used while achieving optimum arrow accuracy. The spiral orientation of the fins 44 and the tendency of the arrow to be rotating around the central longitudinal axis 26 upon contact with an animal allows the arrow to continue rotating as it penetrates the animal. This allows additional tissue to be lacerated, as the distance which a fin 44 travels will be greater than if forced straight through the animal. As rotation is decreased, the width of the fin 44 compresses tissue instead of cutting it, thereby transferring additional energy and increasing the likelihood the arrow will remain in the animal. Positioning the fins 44 in a spiral manner fully exposes the cutting surfaces 48, allowing fins 44 to cut tissue and vegetation which is deflected around the impacting end 20. A fin 44 which is angled away from the direction of travel will tend to deflect material not readily cut (bones, hard vegetation, etc.) around the arrow.

As animals are typically killed by the damage of tissue, loss of blood, or the shocking power of transferred energy, the combination of these conditions will obviously be more effective, rapid, and therefore, more humane than any single condition alone. This invention allows the accuracy required to hit animals properly, while providing all three characteristics of a consistent and rapid kill under a wide range of situations.

What is claimed is:

1. An arrow tip consisting essentially of: a body having an impacting end at one end of said body, a trailing end at the opposing end of said body, an interface between said body and said impacting end, and a longitudinal axis;

said impacting end having a centrally located point, said point being the apex of a first conical shaped small, in reference to said longitudinal axis, slope penetrating section having a surface which traverses across an intersection to a second conical shaped large, in reference to said longitudinal axis, slope energy imparting section having a surface and ending at said interface with said body;

the first slope section comprising a continuous line segment devoid of angular meeting points from said point to said intersection;

the second slope section comprising a continuous line segment devoid of angular meeting points from said intersection to said interface;

said body traversing into a truncated trailing end having a surface.

2. A tip according to claim 1, wherein said point is a diameter up to one-half the diameter of the body.

3. A tip according to claim 1, wherein the penetrating section is concave, said penetrating section having a surface.

4. A tip according to claim 3, wherein any tangent of said surface making an angle with said longitudinal axis is up to, but not including fifty degrees.

5. A tip according to claim 1, wherein the penetrating section is convex.

6. A tip according to claim 5, a plane extending between the point and the intersection of the penetrating and imparting sections making an angle with said longitudinal axis is up to but not including fifty degrees.

7. A tip according to claim 1, wherein the imparting section is concave, said imparting section having a surface.

8. A tip according to claim 7, wherein any tangent of said surface making an angle with said longitudinal axis is from fifty degrees up to but not including ninety degrees.

9. A tip according to claim 1, wherein the imparting section is straight, said imparting section having a surface.

10. A tip according to claim 9, wherein any angle said surface makes with the central longitudinal axis is from fifty degrees up to but not including ninety degrees.

11. A tip according to claim 1, wherein the imparting section is convex, said imparting section having a surface.

12. A tip according to claim 11, wherein any plane extending from the intersection of the penetrating and imparting sections to the interface between said imparting section and the body making an angle with said longitudinal axis is from fifty degrees up to but not including ninety degrees.

13. A tip according to claim 1, wherein said impacting end has a surface and said surface is continuous.

14. A tip according to claim 1, wherein said impacting end has a surface and said surface is discontinuous.

15. A tip according to claim 1, wherein the surface of said impacting end is faceted.

16. A tip according to claim 1, wherein said body is faceted.

17. A tip according to claim 1, wherein the surface of at least one of the slope sections is asymmetrical along the length of the surface.

18. An arrow tip comprising: a body having an impacting end at one end of the body, a trailing end at the opposing end of said body, an interface between said body and said impacting end, and a longitudinal axis;

said impacting end having a centrally located point, said point being the apex of a first conical shaped small, in reference to said longitudinal axis, slope penetrating section having a surface which traverses across an intersection to a second conical shaped large, in reference to said longitudinal axis, slope energy imparting section having a surface and ending in the interface with said body;

the penetrating section is concave and any tangent of the surface of said penetrating section making an angle with said longitudinal axis is up to, but not including fifty degrees;

the imparting section is concave and any tangent of the surface of said imparting section making an angle with said longitudinal axis is from fifty degrees up to but not including ninety degrees;

said body traversing into a truncated trailing end.

19. A tip comprising: a body having an impacting end at one end, a trailing end at the opposing end, a length, a surface, and a perimeter;

said trailing end having a length, surface, a perimeter, and at least one outwardly extending member or surface;

said outwardly extending member or surface having a longitudinal axis at an angle to a central longitudinal axis of said tip.

20. A tip according to claim 19, wherein said outwardly extending members or surfaces are continuous around said perimeter of said trailing end.

21. A tip according to claim 19, wherein said outwardly extending members or surfaces are discontinuous around said perimeter of said trailing end.

22. A tip according to claim 19, wherein said outwardly extending members or surfaces are discontinuous along the length of at least one of the body and said trailing end.

23. A tip according to claim 19, wherein said outwardly extending members or surfaces are a width of at least two percent of said perimeter of said tip.

24. A tip according to claim 19, wherein said outwardly extending members or surfaces are attached to said body.

25. A tip according to claim 19, wherein said outwardly extending members or surfaces are a part of the body.

26. A tip according to claim 19, wherein said outwardly extending members or surfaces are contoured in a manner selected from the group comprising twisted, spiral, helical, angled, chambered, and offset.

27. A tip according to claim 19, wherein the body is faceted.

28. A tip according to claim 19, wherein said trailing end is faceted.

29. A tip according to claim 19, wherein said outwardly extending surfaces are a portion of a wall around an annulus which is formed outward.

30. A tip comprising: a body having an impacting end at one end, a trailing end at the opposing end, a length, a surface, and a perimeter;

said trailing end having a length, surface, a perimeter, and at least one outwardly extending member or surface, said outwardly extending members or surfaces are discontinuous around said perimeter of said trailing end or along the length of at least one of said body and said trailing end;

said outwardly extending member or surface having a longitudinal axis at an angle to a central longitudinal axis of said tip;

said outwardly extending members or surfaces are contoured in an angled manner.

* * * * *